US009405238B2

(12) United States Patent
Hatazaki

(10) Patent No.: US 9,405,238 B2
(45) Date of Patent: Aug. 2, 2016

(54) URGING ROLLER, CLEANING DEVICE AND IMAGE HEATING DEVICE

(71) Applicant: CANON KABUSHIKI KAISHA, Tokyo (JP)

(72) Inventor: Kazunari Hatazaki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/615,875

(22) Filed: Feb. 6, 2015

(65) Prior Publication Data

US 2015/0234342 A1 Aug. 20, 2015

(30) Foreign Application Priority Data

Feb. 17, 2014 (JP) ..... 2014-027558
Feb. 17, 2014 (JP) ..... 2014-027559

(51) Int. Cl.
*G03G 21/00* (2006.01)
*G03G 15/20* (2006.01)

(52) U.S. Cl.
CPC ..... *G03G 15/2025* (2013.01); *G03G 15/2075* (2013.01); *G03G 21/0041* (2013.01); *G03G 2221/1639* (2013.01)

(58) Field of Classification Search
CPC ..... G03G 15/0225; G03G 15/2025; G03G 15/2075; G03G 2221/1639
USPC ..... 399/352
See application file for complete search history.

(56) References Cited

U.S. PATENT DOCUMENTS 5,797,063 A 8/1998 Umezawa et al.

FOREIGN PATENT DOCUMENTS

JP 01-237583 A 9/1989
JP 03-181981 A 8/1991
JP 2002-189373 A 7/2002

OTHER PUBLICATIONS

Machine translation of JP2002-189373.*
Search Report dated Jul. 28, 2015, in European Patent Application No. 15154494.7.
U.S. Appl. No. 14/603,455, filed Jan. 23, 2015.

* cited by examiner

*Primary Examiner* — David Gray
*Assistant Examiner* — Andrew V Do
(74) *Attorney, Agent, or Firm* — Fitzpatrick, Cella, Harper & Scinto

(57) ABSTRACT

An urging roller for urging a cleaning web to a rotatable member of an electrophotographic image forming apparatus includes a shaft; an elastic layer provided on a peripheral surface of the shaft; a wire wound on a peripheral surface of the elastic layer; and a toner parting layer coating a peripheral surface of the elastic layer with the wire.

21 Claims, 10 Drawing Sheets

URGING ROLLER, CLEANING DEVICE AND IMAGE HEATING DEVICE

FIELD OF THE INVENTION AND RELATED ART

The present invention relates to an urging roller, a cleaning device and an image heating device usable with an electrophotographic image forming apparatus.

Various types of cleaning devices for cleaning a fixing device (image heating apparatus) in an electrophotographic image forming apparatus are known.

Japanese Laid-open Patent Application 2002-189373 discloses one of them, in which offset toner is collected from a fixing roller to a cleaning roller, and the toner collected to the cleaning roller is removed by a cleaning device using a cleaning web.

With this cleaning device, the cleaning web is press-contacted to a rotating cleaning roller to rub it, so that the toner collected on the cleaning roller is wiped off by the cleaning web. By moving the cleaning web at appropriate timing, an unused portion of the cleaning web rubs the cleaning roller.

An urging roller is used to urge the cleaning web to the cleaning roller, and it has a sponge layer (elastic layer) on which wire is spirally wound thereon.

However, in the case of the urging roller disclosed in Japanese Laid-open Patent Application 2002-189373, there is a liability that the toner soaked in the cleaning web may transfer onto the sponge layer of the urging roller.

SUMMARY OF THE INVENTION

According to an aspect of the present invention, there is provided an urging roller for urging a cleaning web to a rotatable member of an electrophotographic image forming apparatus, said urging roller comprising a shaft; an elastic layer provided on a peripheral surface of said shaft; a wire wound on a peripheral surface of said elastic layer; and a toner parting layer coating a peripheral surface of said elastic layer with said wire.

According to another aspect of the present invention, there is provided a cleaning device for cleaning a rotatable member for an electrophotographic image forming apparatus, said cleaning device comprising (i) a cleaning web for cleaning the rotatable member; (ii) a wound roller on which said cleaning web is wound; (iii) a winding-up roller for winding said cleaning web up; and (iv) an urging roller for urging said cleaning web to the rotatable member, said urging roller including (iv-i) a shaft, (iv-ii) an elastic layer provided on a peripheral surface of said shaft, (iv-iii) a wire wound on a peripheral surface of said elastic layer; and (iv-iv) a toner parting layer coating of peripheral surface of said elastic layer with said wire.

According to a further aspect of the present invention, there is provided an image heating apparatus comprising (i) a rotatable heating member for heating a toner image on a sheet; (ii) a collection rotatable member for collecting toner deposited on said rotatable heating member; (iii) a cleaning web for cleaning said collection rotatable member; (iv) a wound roller on which said cleaning web is wound; and (v) a winding-up roller for winding up said cleaning web; (vi) an urging roller for urging said cleaning web to the collection rotatable member, said urging roller including (vi-i) a shaft; (vi-ii) an elastic layer provided on a peripheral surface of said shaft; (vi-iii) a wire wound on a peripheral surface of said elastic layer; and (vi-iv) a toner parting layer coating a peripheral surface of said elastic layer with said wire.

Further features of the present invention will become apparent from the following description of exemplary embodiments with reference to the attached drawings.

DESCRIPTION OF THE EMBODIMENTS

A fixing device as an image heating apparatus and an electrophotographic image forming apparatus provided with the fixing device according to an embodiment of the present invention will be described. The specific values in the following description of the embodiments are examples and do not limit the present invention. The embodiments are examples of the present invention, which is not limited to the specific examples.

[Embodiment 1]

<Example of Image Forming Apparatus>

Figure 2:
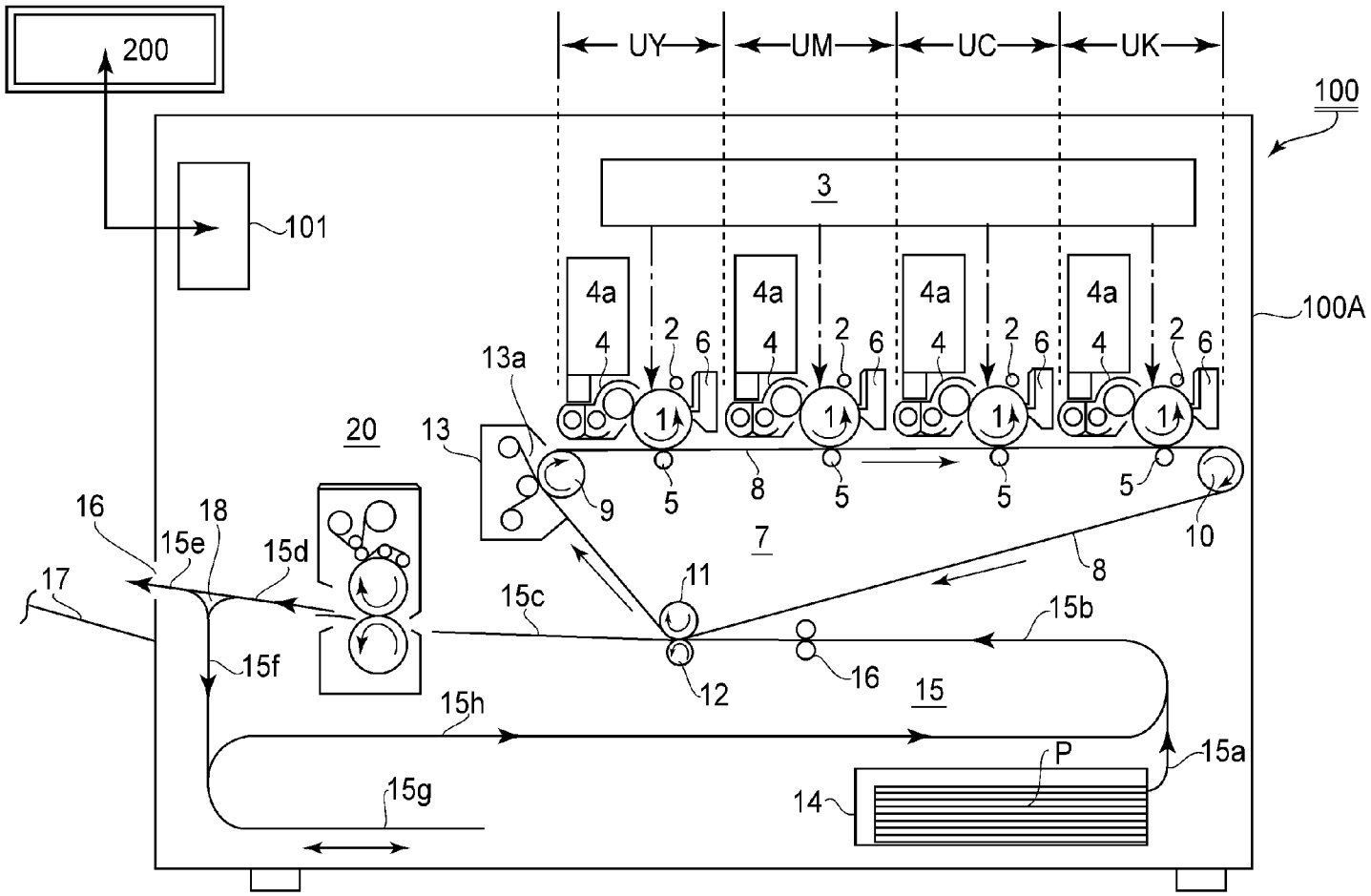
FIG. 2 is a schematic view illustrating a general arrangement.

FIG. 2 is a schematic view illustrating structures of the electrophotographic image forming apparatus 100 according to this embodiment. The image forming apparatus 100 is an electrophotographic full color laser beam printer of an in-line (tandem) and middle transfer belt type. It is capable of forming a full-color image on a recording material (recording paper) P in accordance with electrical image information supplied from a host apparatus 200 such as a personal computer to a control circuit portion (controlling means) 101 of the image forming apparatus.

In a main assembly A 100A of the image forming apparatus 100, there are provided first-fourth image forming stations U (UY, UM, UC, UK) arranged in the order named at predetermined intervals substantially along a horizontal direction. The image forming stations U have similar electrophotographic processing mechanisms which are different only in the colors of the image formed thereby. Each image forming station U comprises a drum type electrophotographic photosensitive member (drum) 1 as an image bearing member rotated at a predetermined peripheral speed in the counterclockwise direction indicated by an arrow. The image forming station U also comprises a charger (charging roller) 2, a developing device 4, a primary transfer charger (primary transfer roller) 5, a drum cleaner 6 as a process means actable on the drum 1.

The charger 2 electrically charges the surface of the drum 1 to a potential of a predetermined polarity. The developing device 4 develops an electrostatic latent image formed on the drum 1 with a developer (toner). The primary transfer charger 5 primary-transfers a toner image formed on the drum 1 onto the intermediary transfer belt 8. The drum cleaner 6 cleans the drum surface after toner image transfer onto the intermediary transfer belt 8.

The developing device 4 of the first image forming station UY contains a predetermined amount of yellow (Y) toner supplied by a supplying device 4*a* to form a toner image of yellow color on the drum 1. The developing device 4 of the second image forming station UM contains a predetermined amount of magenta (M) toner supplied by the supplying device 4*a* to form a magenta toner image on the drum 1. The developing device 4 of the third image forming station UC contains a predetermined amount of cyan (C) toner supplied by the supplying device 4*a* to form a cyan toner image on the drum 1. The developing device 4 of the fourth image forming station UK contains a predetermined amount of black (K) toner by the supplying device 4*a* to form a black toner image on the drum 1.

Above the first-fourth image forming stations U, there is provided a laser scanner 3. The laser scanner 3 projects a beam corresponding to image information on the drum 1 in each of the image forming stations U to form an electrostatic latent image on the drum 1. Although not shown in the Figure, the laser scanner 3 comprises a light source device and a polygonal mirror, with which the laser beam generated by the light source device is scanningly deflected by the rotation of the polygonal mirror. The scanning beam is deflected by a reflection mirror and is focused on the drum 1 of image forming station U by an fθ lens along the generatrix line of the drum 1. By this, latent images are formed on the respective drums 1 of the image forming stations U in accordance with the respective the image signals.

Below the first-fourth image forming stations U, an intermediary transfer belt unit 7 is provided. The unit 7 comprises a driving roller 9 in a first image forming station (UY) side, a tension roller 10 in the fourth image forming station (UK) side, and a secondary transfer opposing roller 11 at a level lower than the driving roller 9. It also comprises an intermediary transfer belt (belt) 8 which is a flexible endless belt stretched around these three rollers 9-11.

The primary transfer charger 5 of each of the image forming stations U is disposed inside of the belt 8 and is contacted to the lower surface of the drum 1 opposed to the upper traveling part of the belt 8. In each of the image forming stations U, a primary transfer portion is a contact portion between the drum 1 and the belt 8. Belt 8 is rotated substantially at the same speed as the peripheral speed of the drum 1 in the clockwise direction indicated by an arrow by the driving roller 9. Toward the secondary transfer opposing roller 11, a secondary transfer roller 12 is urged with the belt 8 therebetween. A secondary transfer portion is the contact portion between the belt 8 and the secondary transfer roller 12.

At a portion of the belt at the driving roller 9, a belt cleaner 13 is provided. The cleaner 13 comprises a cleaning web (non-woven fabric) 13*a* for cleaning a belt surface after the secondary-transfer of the toner image onto the recording paper P from the belt 8. Below the intermediary transfer belt unit 7, a sheet feeding cassette 14 accommodating the recording sheets P and a recording paper feeding mechanism 15 is provided.

A full-color image forming operation is as follows. By the image forming operation of the image forming apparatus 100, a Y chromatic toner image corresponding to the Y color component of the full-color image is formed on the drum 1 of the first image forming station UY. The toner image is primary-transferred onto the belt 8 in the primary transfer portion. On the drum 1 of the second image forming station UM, an M chromatic toner image corresponding to the M color component of the full-color image is formed. The toner image is primary-transferred superimposedly onto the Y chromatic toner image already transferred on the belt 8, at the primary transfer portion.

On the drum 1 of the third image forming station UC, a C color toner image corresponding to the C color component of the full-color image is formed. The toner image is primary-transferred superimposedly onto the Y color+M color toner images already transferred onto the belt 8 in the primary transfer portion. On the drum 1 of the fourth image forming station UK, a K chromatic toner image corresponding to the K color component of the full-color image is formed. The toner image is primary-transferred superimposedly onto the Y color+M color+C color toner images already transferred onto the belt 8 in the primary transfer portion.

In the primary-transfer of the toner image from the drum 1 onto the belt 8 in the image forming station U, a bias voltage of a polarity opposite the regular charge polarity of the toner is applied to the primary transfer charger 5. In this manner, a synthesized color toner image (unfixed) of four full-colors (Y+M+C+K) is formed on the belt 8. The synthesized color toner image is formed with a predetermined marginal blank portion at 4 side edge portions of the recording paper P. In this embodiment, a leading end marginal blank portion is approx. 2-3 mm.

On the other hand, a recording sheet P is singled out and a predetermined control timing from the sheet feeding cassette 14 to the pair of registration rollers 16 along a paper path 15*a* and a paper path 15*b* of the recording paper feeding mechanism 15. Then, the recording sheet is introduced into the secondary transfer portion at the predetermined control timing by the pair of registration rollers 16. By this, in the process of the recording sheet P being fed through the secondary transfer portion, the four color superimposed toner image is secondary-transferred from the belt 8 onto the recording paper gradually. In the secondary-transfer, a bias voltage of a polarity opposite to the regular charge polarity of the toner is applied to the secondary transfer roller 12 to effect the image transfer.

The recording sheet P now carrying the secondary-transferred toner image is introduced into a fixing device 20 as an image heating apparatus through the paper path 15*c* and is subjected to a fixing process, and then is discharged onto a sheet discharge tray 17 as a full-color print through a paper path 15*d*, a paper path 15*e* and a sheet discharge opening 16.

The image forming apparatus 100 of the present invention is not limited to the full-color image formation, but is applicable to a monochromatic image having a desired mono-color or multi-color images having desired colors. In such a case, only the image forming station or stations U for the monochromatic color or multi-colors are operated. In the unnecessary image forming station or stations, the image forming operation is not carried out, although the drum 1 is rotated.

The same applies to the case of both side printing. In such a case, the recording sheet P already having the image on one side is discharged from the fixing device 20 and is switched by a flapper 18 to the paper path 15*f*, and is introduced into a reversion path (switchback path) 15*g* and then into a both-side-printing path (refeeding paper path) 15*h*. It is reintroduced into the paper path 15*b* and is fed to the secondary transfer portion in the face-reversed state. By this, a toner image is secondary-transferred onto the second side of the recording sheet P. Thereafter, it is discharged onto the sheet discharge tray 17 as a both sided print through the paper path 15*c*, the fixing device 20, the paper path 15*d*, the paper path 15*e* and in the sheet discharge opening 16, similarly to the case of the one-side printing.

Here, the fixing device 20 of the image forming apparatus 100 according to this embodiment effects oil-less fixing of the toner image recording sheet with heat and pressure, the toner containing parting material.

The toner used in the image formation contains (internally) a parting material such as a wax of paraffin or polyolefin or silicone oil. More specifically, in this embodiment, pulverized toner particle internally contains dispersed pigment and wax component. Polymerized toner containing such a wax component may be used. In the following descriptions, the parting material is wax, but the description applies to the case of using silicone oil as the parting material.

<Image Fixing Device>

In this embodiment, the fixing device (image heating apparatus) 20 of the electrophotographic image forming apparatus 100 fixes the toner image formed on the recording sheet P with the toner containing the parting material, while applying heat and pressure to the toner. The description will be made more specifically.

Figure 1:
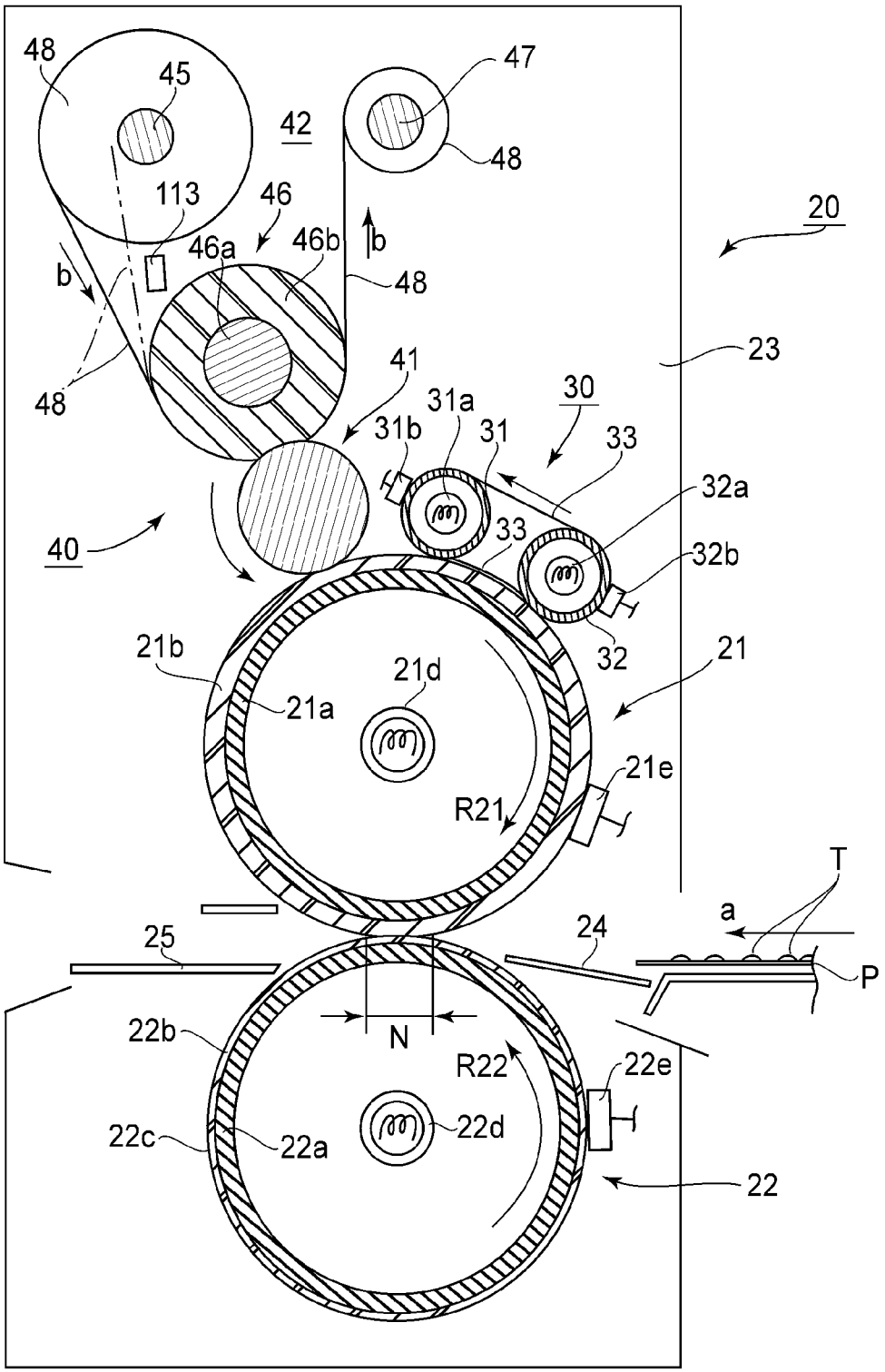
FIG. 1 is a schematic enlarged cross-sectional view of a fixing device.
Figure 3:
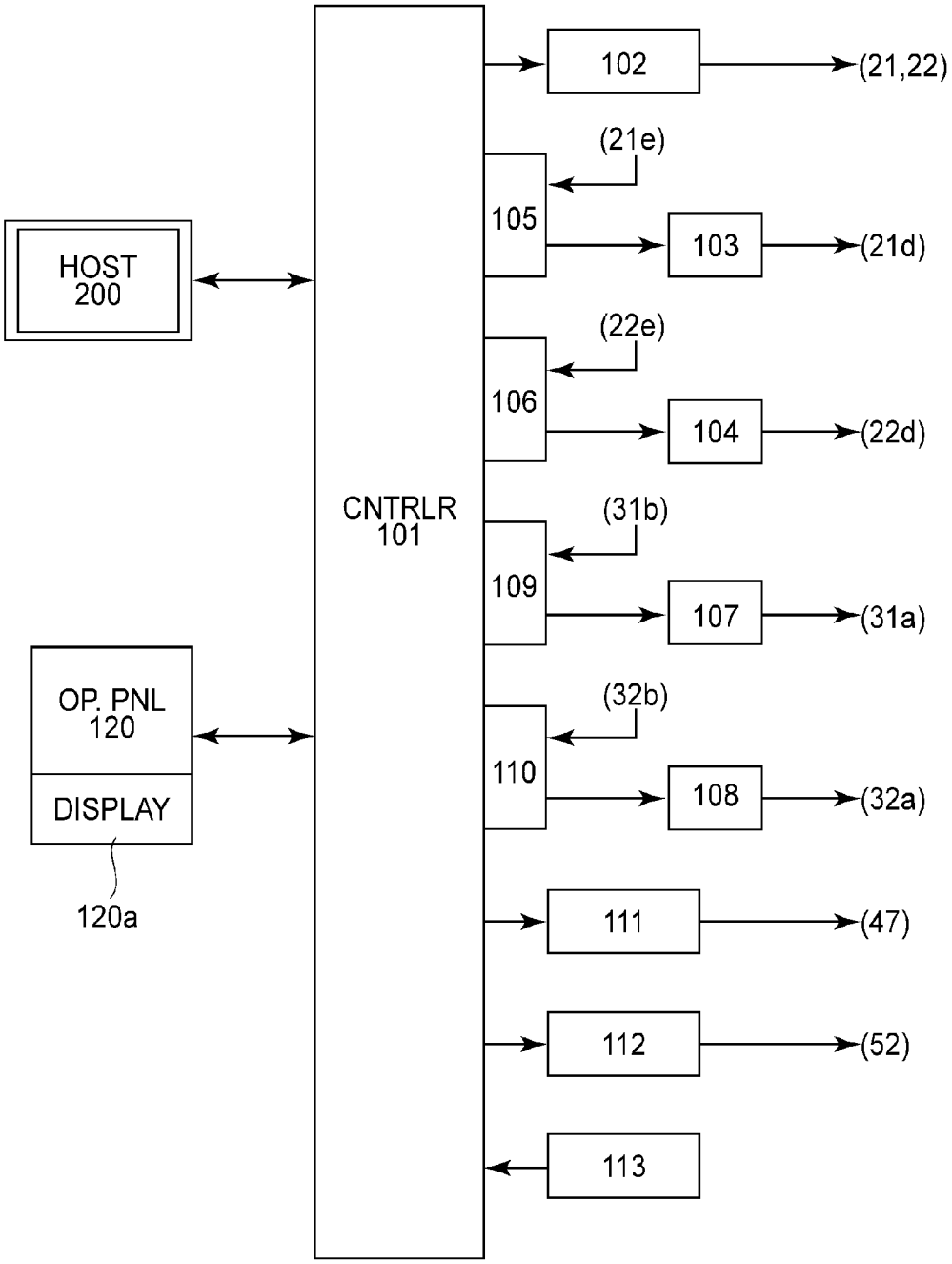
FIG. 3 is a block diagram of a control system of the fixing device.

FIG. 1 is a schematic enlarged cross-sectional view of the fixing device 20 according to this embodiment. FIG. 3 is a block diagram of a control system for the fixing device 20. The fixing device 20 is a heat roller pair, external heating and oil-less fixing type.

The fixing device 20 comprises fixing rollers as a first rotatable member (rotatable heating member, heating member) 21 for heating the unfixed toner image (un-heated toner image) T on the recording sheet (recording material) in the nip N, and a pressing roller as a second rotatable member (pressing rotatable member, pressing member), constituting a pair of press-contact rollers. It further comprises an external heating belt unit 30 as an external heating means for externally heating the fixing roller 21. It further comprises a fixing roller cleaning mechanism (cleaning device) 40 for cleaning an outer surface of the fixing roller 21.

(1) Image Fixing Roller and Pressing Roller

The fixing roller 21 of this embodiment includes a cylindrical core metal 21*a* of aluminum, an elastic layer having a thickness of 3 mm on the outer peripheral surface thereof, and is a hollow roller having a diameter of 60 mm. The elastic layer 21*b* has a two-layer-structure including a lower layer and an upper layer as a heat resistive elastic layer (parting layer) contactable to an image surface of the recording sheet P. The lower layer is made of HTV (high temperature vulcanization type) silicone rubber layer, and the upper layer is a RTV (room temperature vulcanization type) silicone rubber layer.

The pressing roller 22 includes a cylindrical core metal 22*a* of aluminum, an elastic layer 22*b* having a thickness of 3 mm on the outer surface of the core metal, and a parting layer on the elastic layer 22*b*, and it is a hollow roller having a diameter of 60 mm. The elastic layer 22*b* is a HTV silicone rubber layer, and the parting layer 22*c* is a fluorinated resin material layer.

By combining the fixing roller 21 and the pressing roller 22 which have the above-described layer structures, the parting property relative to the sharp melt toner is further enhanced In order to fix the images on both sides, the RTV or LTV (low temperature vulcanization type) silicone rubber having the high toner parting effect is used for the surface of the pressing roller 22 as well as the fixing roller 21.

The fixing roller 21 is extended substantially horizontally and is rotatably supported at a fixed position by ball bearings (unshown) between side plates of the fixing device casing (chassis) 23 at the opposite end portions. At a rotation axis portion of the fixing roller 21, there is provided a non-rotatable halogen heater 21*d* for the ink in the fixing roller 21 from the inside.

The pressing roller 22 is extended substantially in parallel with the fixing roller 21 below the fixing roller 21 in the substrate rotatably supported by ball bearings (unshown) between side plates of the fixing device casing 23 at the opposite end portions. At a rotation axis portion of the pressing roller 22, there is provided with a known rotatable halogen heater 22*d* for heating the pressing roller 22 from the inside.

The ball bearings at the opposite end portions of the pressing roller 22 permit sliding motion toward the fixing roller 21. The pressing roller 22 is urged to the fixing roller 21 by an urging member (unshown). By this, the pressing roller 22 is press contacted to the fixing roller 21 against the elastic forces of the elastic layers 21*b*, 22*b* at the predetermined pressure to form a fixing nip (heating nip) having a predetermined width measured in a recording paper feeding direction between the rollers 21, 22. In this embodiment, the pressing roller 22 is press contacted to the fixing roller 21 at a total pressure of approx. 784 N (approx. 80 kg).

The fixing roller 21 and the pressing roller 22 are provided with respective gears fixed to the axial ends, and the gears are in meshing engagement with each other and are rotated by a driving force from a driving portion 102 controlled by the control circuit portion 101. By this, the fixing roller 21 and the pressing roller 22 are rotated in the direction indicated by arrows R21 and R22, that is, in the directions for feeding the recording paper is by the nip N, at a predetermined peripheral speed.

The halogen heaters 21*d* and 22*d* of the fixing roller 21 and the pressing roller 22 generate heat by receiving electric power supply from voltage source portions 103, 104 (FIG. 3). By the generated heat, the fixing roller 21 and the pressing roller 22 are heated from the inside so that the surface temperatures rise.

To the fixing roller 21 and the pressing roller 22, thermistors (temperature detecting means) 21*e* and 22*e* for detecting that the surface temperatures of the respective rollers are contacted. The thermistor 21*e* is contacted to the fixing roller 21 at the position upstream of the fixing nip N and downstream of a position of an external heating belt unit 30 which will be described hereinafter, with respect to the peripheral movement of the fixing roller.

Temperature information a detected by the thermistors 21*e* and 22*e* is supplied to the temperature adjustment circuit portions 105 and 106 of the control circuit portion 101. The temperature adjustment circuit portion 105 controls the electric power supply to the halogen heater 21*d* from the voltage source portion 103 so that the surface temperature of the fixing roller 21 detected by the thermistor 21*e* converges to a predetermined temperature (approx. 165 degree C. in this embodiment). The temperature adjustment circuit portion 106 controls the electric power supply to the halogen heater 22*d* from the voltage source portion 104 so that the surface temperature of the pressing roller 22 detected by the thermister 22*e* converges to a predetermined temperature (approx. 140 degree C. in this embodiment).

The fixing roller 21 and the pressing roller 22 are rotated, and the surface temperatures thereof are raised to and maintained at the respective predetermined temperatures. In this state, a recording paper carrying an unfixed toner image T is introduced into the fixing device 20 from the image forming station. Designated by reference numeral 24 is a recording paper guiding plate in the entrance side.

The recording paper P is introduced into and fed through the nip N with the unfixed toner image carrying side contacted to the fixing roller 21 during which the unfixed toner image T is fixed into a fixed image by the heat and pressure in the nip N. That is, the fixing roller 21 (first rotatable member) is on the side contacting to the toner image T on the recording paper. The recording paper P having passed through the nip N is separated from the fixing roller 21 and is discharged out of the fixing device 20 along the recording paper guiding plate 25 at the exit side.

(2) External Heating Belt Unit:

The external heating belt unit 30 externally heats the fixing roller 21. Using the external heating type, a printing productivity (print number per unit time) particularly on large basis weight sheets such as rough paper, emboss paper or coated paper can be increased.

The external heating belt unit 30 in this embodiment comprises first and second supporting rollers 31, 32, respective halogen heaters 31*a*, 32*a* therein, and an endless external heating belt 33 extended around the rollers 31, 32. The first and second supporting rollers 31, 32 are rotatable and support the external heating belt 33 at the inner surface so as to press-contact the external heating belt 33 to the fixing roller 21. The external heating belt 33 is closely contacted to the outer surface of the fixing roller 21 along the roller curvature, that is, over a wide range with respect to the widthwise direction, between the first and second supporting rollers 31, 32.

The external heating belt 33 is rotated by the rotation of the fixing roller 21. The first and second supporting rollers 31, 32 are rotated by the rotation of the external heating belt 33. The first and second supporting rollers 31, 32 are internally heated by the halogen heaters 31*a*, 32*a*, respectively, which are supplied with electric power supply from the voltage source portions 107, 108. The heat is transferred to the external heating belt 33 through the first and second supporting rollers 31, 32 and then to the surface of the fixing roller 21, so that the decrease of the surface temperature of the fixing roller is prevented.

The temperature of the external heating belt 33 is detected by a thermistor 31*b* contacted to the surface of the belt at the position of the first supporting roller 31. In addition, the temperature of the belt is detected by a thermistor 32*b* contacted to the belt surface at the second supporting roller 32.

Temperature information detected by the thermistors 31*b* and 32*b* is supplied to the temperature adjustment circuit portions 109 and 110 of the control circuit portion 101. The temperature adjustment circuit portion 109 controls the electric power supply to the halogen heater 31*a* from the voltage source portion 107 so that the surface temperature of the external heating belt 33 detected by the thermistor 31*b* converges to a predetermined target temperature. The temperature adjustment circuit portion 110 controls the electric power supply to the halogen heater 32*a* from the voltage source portion 108 so that the surface temperature of the external heating belt 33 detected by the thermistor 32*b* converges to a predetermined target temperature.

The target temperature of the external heating belt 33 is higher than the target temperature of the fixing roller 21 by the predetermined degree. With this structure, against the drop of the surface temperature of the fixing roller 21 caused by the contact to the recording paper in the fixing nip N, the heat can be applied to the fixing roller 21 from the external heating belt 33 with high responsivity (thermal responsivity).

(3) Image Fixing Roller Cleaning Mechanism

A fixing roller cleaning mechanism 40 comprises a collection roller (cleaning roller) 41 for collecting offset toner which has been offset from the recording paper P onto the fixing roller 21 in the fixing nip N.

In this embodiment, the collection roller 41 is a metal roller of SUS303 having an outer diameter ϕ20 mm. The collection roller 41 is contacted to the fixing roller 21 and is extended substantially in parallel with the fixing roller 21 at a position above the fixing roller 21 and upstream of the position of the external heating belt unit 30 with respect to the peripheral moving direction of the fixing roller. The roller 41 is rotatably supported by ball bearings (unshown) between the side plates of the fixing device casing 23 at the opposite end portions of the roller 41.

The collection roller 41 is rotated by the rotation of the fixing roller 21, and the offset toner (another deposited matter on the surface of the fixing roller, such as paper dust) is deposited, transferred and collected from the surface of the fixing roller onto the surface of the collection roller 41. The collection roller 41 is always in contact with the fixing roller 21 for the purpose of collecting the deposited matter on the surface of the fixing roller 21, in addition to the period of the image forming operation of the image forming apparatus. The toner collected on the surface of the collection roller 41 is removed by a cleaning web (cleaning sheet) 48 of the web unit (cleaning device) 42.

Figure 4:
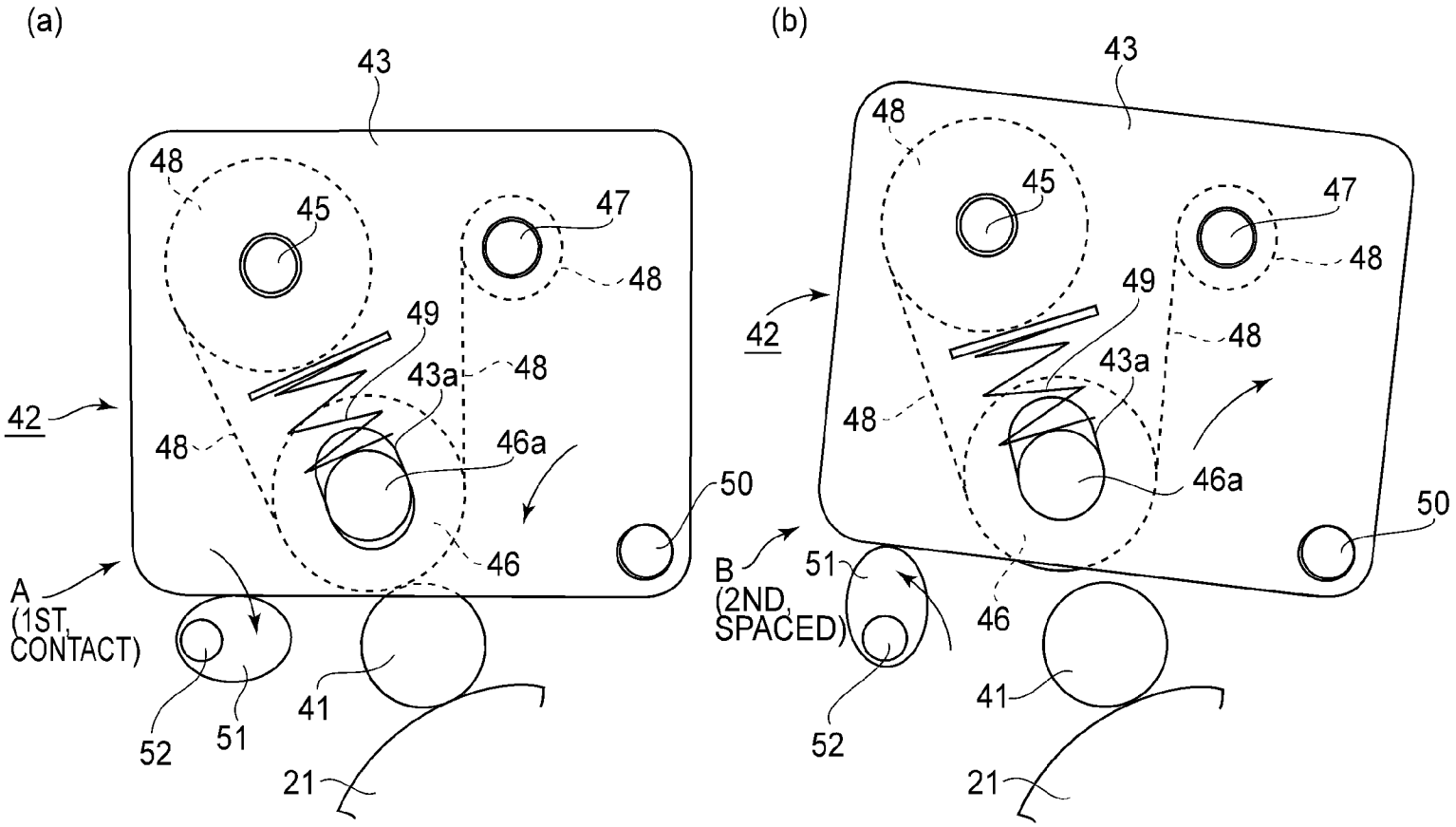
FIG. 4 is an illustration of operation of the cleaning device (web unit).
Figure 5:
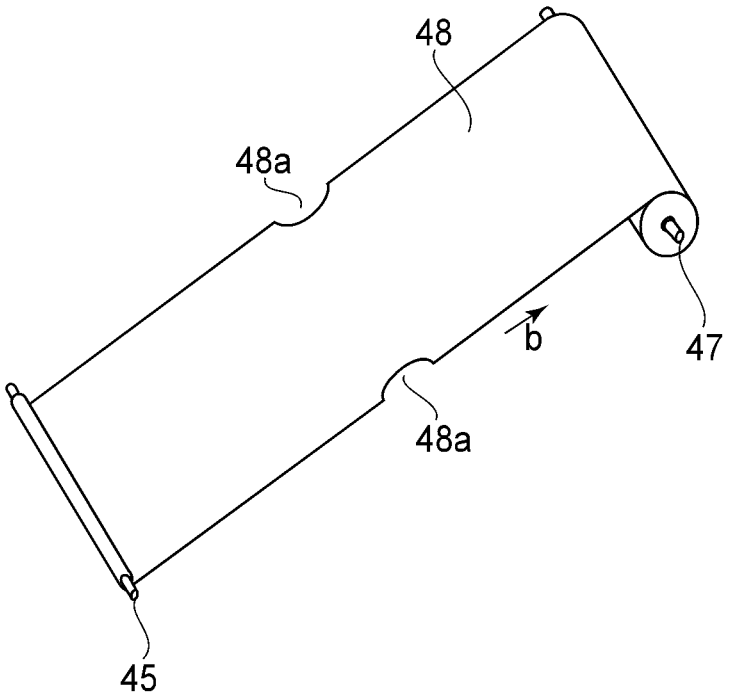
FIG. 5 is an illustration of a cut-away portion provided in the cleaning web.

Referring to FIG. 1 and FIG. 4, the structures of the web unit 42 in this embodiment will be described. The web unit 42 comprises a unit casing (chassis) 43. It further comprises a wound roller 45, a web roller (pressing roller) 46 and a winding-up roller 47 supported between opposing side plates of the casing 43. The cleaning web 48 is a long non-endless non-woven fabric wound on the wound roller 45.

The wound roller 45 is rotatably supported between the opposing side plates of the casing 43. The cleaning web 48 is extended around the web roller 46, and a leading end portion of the cleaning web 48 is fixed on the winding-up roller 47.

The web roller 46 is an elastic roller contacted to the upper surface of the collection roller 41 to be cleaned, through the cleaning web 48. As will be described hereinafter, the web roller comprises a core metal 46*a* (shaft), a sponge layer provided on a peripheral surface of the core metal (elastic layer 46*b*), a wire 46*c* of metal spirally extended (wound) on the sponge layer 46*b*, and a coating layer (toner parting layer) coating the peripheral surface of the sponge layer 46*b* including the wire 46*c*. The elastic layer is a porous sponge layer, taking the heat insulation property into account.

The opposite end portions of the core metal (shaft) 46*a* of the web roller 46 are engaged with round elongated holes 43*a* of the opposing side plates of the casing 43, respectively. By this, the web roller 46 is rotatably supported between the side plates so as to be slidable along the elongated holes 43*a*.

The direction of the sliding is perpendicular to the nip between the web roller 46 and the collection roller 41 (the direction connecting the center of the core metal of the web roller 46 and the center of the collection roller 41). The opposite end portions of the core metal 46*a* are urged toward bottom end portions of the elongated hole 43*a* by urging springs 49 provided on the side plates.

One end portion side of the winding-up roller 47 is connected with a driving portion (motor) 111 for winding up the cleaning web 48. By the driving portion 111 controlled by the control circuit portion 101, the winding-up roller 47 is rotated in the winding-up direction. By this, the cleaning web 48 is gradually moved in the direction indicated by an arrow b and wound up on the roller 47 by the way of the web roller 46 from the wound roller 45.

More specifically, the control circuit portion 101 intermittently rotates the winding-up roller 47 by the driving portion 111 at predetermined control timing by a predetermined angle of rotation, thus intermittently and gradually winding up the cleaning web 48 from the wound roller 45 to the winding-up roller 47. The web roller 46 rotates together with the winding-up movement of the cleaning web 48.

The web unit 42 is supported swingably about a rotation shaft 50 between the side plates of the fixing device casing 23. The web unit 42 is movable about the rotation shaft 50 between a first position A (part (a) of FIG. 4) and a second position B (part (b) of FIG. 4), by controlling an angle of rotation of a contacting and spacing cam 51. In the first position A of the web unit 42, the cleaning web 48 is in contact with the collection roller 41 (contact state of the cleaning web 48). In the second position B, the cleaning web 48 is spaced from the collection roller 41 (non-contact state of the cleaning web 48).

In this embodiment, the cam shaft 52 is moved by a driving portion 112 controlled by the control circuit portion 101, so that a high portion of a cam profile of the contacting and spacing cam 50 is kept in a position facing horizontally as shown in part (a) of FIG. 4. In this position, the web unit 42 rotates in the counterclockwise direction in FIG. 4 by the weight thereof about the rotation shaft 50, and the web roller 46 urges the cleaning web 48 to the collection roller 41 while comprising the urging spring 49 (first position A).

In this embodiment, in the state that the cleaning web 48 is contacted to the collection roller 41, the web roller 46 urges the cleaning web 48 to the collection roller 41 at an urging force of 40 N by the urging spring 49.

When the contacting and spacing cam 50 takes the position by the driving portion 112, as shown in part (b) of FIG. 4, the high portion of the cam profile faces horizontally. In this position, the web unit 42 is lifted by the contacting and spacing cam 50 about the rotation shaft 49 in the clockwise direction in FIG. 4 so that the web roller 46 is spaced from the collection roller 41 (second position B). In this spaced state of the cleaning web 48, the opposite end portions of the core metal of the web roller 46 are placed at the bottom end portion of the round elongated holes 43*a*, respectively.

In the state that the cleaning web 48 is spaced from the collection roller 41, no urging force is applied to the collection roller 41 from the web unit 42, and therefore, the collection roller 41 is contacted to the fixing roller 21 at an urging force of approx. 10 N (weight) in this embodiment. In the contact state of the cleaning web 48 shown in part (a) of FIG. 4, the collection roller 41 urged toward the fixing roller 21 by approx. 50 N which is a sum of approx. 10 N of the weight and approx. 40 N through the contact of the web roller 46. In this state, the collection roller 41 is driven by the rotation of the fixing roller 21.

As shown in part (a) of FIGS. 1 and 4, by rotating the fixing roller 21 while the cleaning web 48 is kept in contact with the collection roller 41 by the web roller 46, The collection roller 41 is rotated to clean the fixing roller 21. By doing so, the cleaning web 48 removes the toner from the collection roller 41.

The cleaning web 48 contacting the collection roller 41 is gradually wound up in the direction of arrow b, so that a fresh part of the web is brought into contact with the collection roller 41 before the web is saturated with the toner. That is, the contact surface of the cleaning web 48 relative to the collection roller 41 is renewed by the movement of the cleaning web 48.

The cleaning web 48 wound on the roller 45 is consumed gradually by being wound up on the roller 47. Therefore, it is desirable that when a small amount of unused part of the web is still on the wound roller 45, the use is prompted so that the user can replace the cleaning web 48 or prepare for the replacement.

This is because of various cases in which the web cannot be replaced immediately. For example, when a large amount of prints have to be produced in one job, it is not desirable to stop the process only because of the shortage of the web 48. Therefore, the above-described prompt is desirable.

Under the circumstances, in order to detect the remaining amount of the web 48, a cut-away portion 48*a* is provided in the cleaning web at a position which is away from the end of the web 48 by a predetermined distance. When the cut-away portion 48*a* appears as a result of consumption of the cleaning web 48 from the wound roller 45 to the winding-up roller 47, the cut-away portion 48*a* is detected by a sensor 113.

The sensor 113 is provided between the wound roller 45 and the web roller 46. The sensor 113 may be a micro-switch having an actuator for detecting the cut-away portion 48*a* by falling into the cut-away portion 48*a*, or a photo-coupler having an optical path which is opened by the cut-away portion 48*a*, for example.

When the control circuit portion 101 receives a cut-away portion detection signal from the sensor 113, it causes a display portion 120*a* of an operating portion 120 of the image forming apparatus 100 or a display portion of the host apparatus 200 to display the information of the small remaining amount of the cleaning web 48. In response to this event, the user replenishes the cleaning web 48 or prepares the replenishment.

Figure 6:
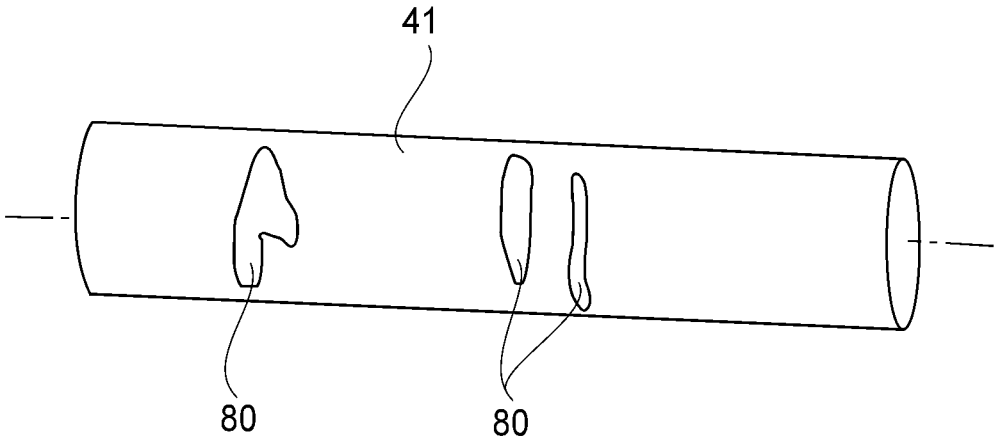
FIG. 6 is a schematic view of agglomeration mass of toner fixed on the collection roller.

(4) Countermeasure for Agglomeration Mass on the Collection Roller:

As described in the foregoing, the collection roller 41 collects the offset toner from the fixing roller 21, using the cleaning web 48. During the collection, the toner which has not been removed by the cleaning web 48 gradually accumulates on the surface layer of the collection roller 41. The accumulated toner is solidified into agglomerated masses 80 on the surface layer of the collection roller 41, as shown in FIG. 6.

The toner once solidified on the surface layer of the collection roller 41 is not easily removed by an ordinary cleaning operation of the cleaning web 48. The presence of the agglomerated mass deteriorates the cleaning effect of the collection roller 41 even to such an extent that the collection roller 41 has to be changed.

The agglomerated mass tends to be produced more if the amount of the offset toner collected on the collection roller 41 from the fixing roller 21 is more. The amount of the offset toner is large when the temperature of the fixing roller 21 is higher or lower than the proper value, and recently, the images are frequently formed on various kind of paper with a constant temperature control, which necessitates processing with non-optimum temperature control for the respective kinds of paper. Under the circumstances, the amount of the offset toner becomes relatively large, and therefore, the web unit 42 is desired to have a high cleaning property in the cleaning of the collection roller 41.

As a counter measurement for the formation of the agglomerated mass by enhancing the cleaning property of the web unit 42, it is preferable to provide the peripheral surface of the elastic layer of the web roller with the wire as disclosed in above-mentioned Japanese Laid-open Patent Application 2002-189373.

Figure 10:
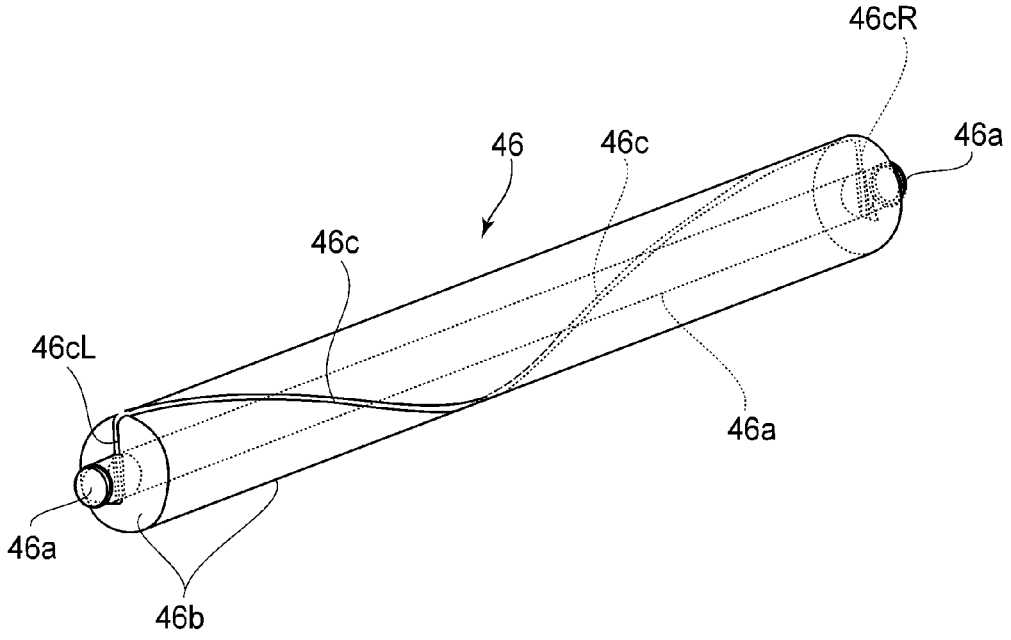
FIG. 10 is a schematic view of a conventional example web roller.

FIG. 10 shows a specific structure with reference numerals common to this embodiment for the elements having the same functions. In this web roller 46, a high stiffness metal (SUS303) is penetrated through the center of the shaft 46*a* in other to suppress flexure thereof when it is contacted to the collection roller 41. In order to enhance the cleaning power, it is preferable to make wide the nip width relative to the collection roller 41, and in view of this, a heat resistive and easily deformable elastic layer (sponge layer) 46*b*, more particularly, silicone sponge is provided on the shaft 46*a* into a roller shape having a diameter of ϕ30 mm. However, the coating layer 46*d* is not coated.

The wire 46*c* of metal (SUS304) having a diameter of ϕ1.0 mm is extended spirally on the surface of the elastic layer along the axial direction by one-full turn, and the opposite end portions 46*c*L, 46*c*R of the wire 46*c* are fixed on the shaft 46*a*, respectively. The wire 46*c* has a hardness higher than that of the elastic layer.

The web roller 46 is urged toward the collection roller 41 to press-contact with the cleaning web 48 to the collection roller 41, by which the elastic layer 46*b* is elastically deformed, and the wire 46*c* is press-contacted to the surface of the collection roller 41 restoring force of the elastic member behind the wire 46*c*. Therefore, the pressure applied by the cleaning web 48 to the collection roller 41 is locally increased.

In other words, when the nip is formed between the collection roller 41 and the cleaning web 48, the nip pressure is raised locally at the position where the wire 46*c* exists. Therefore, at the timing of the wire 46*c* press-contacting the web 48 to the collection roller 41 during the rotation of the web roller 46 by the winding-up movement of the web 48, the pressure of the press-contact between the cleaning web 48 and the collection roller 41 is increased locally.

By doing so, the deposited matter such as solidified toner and/or externally added material on the collection roller 41 can be effectively removed by the cleaning web 48, and therefore, the agglomerated mass on the collection roller 41 can be effectively suppressed.

On the other hand, as described hereinbefore, the cleaning web 48 is provided with the cut-away portion 48*a* at the position away from the end of the web 48 for the opposite of the remaining length detection. Therefore, when the cut-away portion 48*a* is detected by the sensor 113, there exists a fresh part of the web on the wound roller 45.

Therefore, even after the sensor 113 detects the cut-away portion 48*a*, the fixing device 20 is still openable for a while. During such a period, the cut-away portion 48*a* of the web 48 passes through the nip between the collection roller 41 and the web roller 46.

In such a case, that is, in the case of the structure of the web roller 46 shown in FIG. 10, the hard wire 46*c* on the surface of the web roller 46 directly contacts the collection roller 41 through the cut-away portion 48*a* of the web 48. Then, the collection roller 41 may be damaged, which may lead to damage to the fixing roller.

In addition, when the toner soaking into the cleaning web is transferred onto the sponge layer (elastic layer) of the web roller, it may be hardened with an intentional result of non-uniform distribution of the pressure between the web roller and the cleaning roller along the longitudinal direction.

In addition, the wire 46*c* is fixed only at the end portions thereof, and therefore, the wire 46*c* may easily move on the surface of the roller, in the longitudinal in central portions of the web roller 46. Particularly, when the wire 46*c* is in the nip between the collection roller 41 and the web roller 46, the wire 46*c* is easily deviated by the driving force from the collection roller 41. Despite the fact that the wire is additionally provided for the purpose of local high-pressure portion in the nip, the deviation of the wire in the nip results in no such high pressure, and therefore, the cleaning property is deteriorated even to such an extent that the gradually increasing agglomerated mass becomes unable to be removed.

Figure 7:
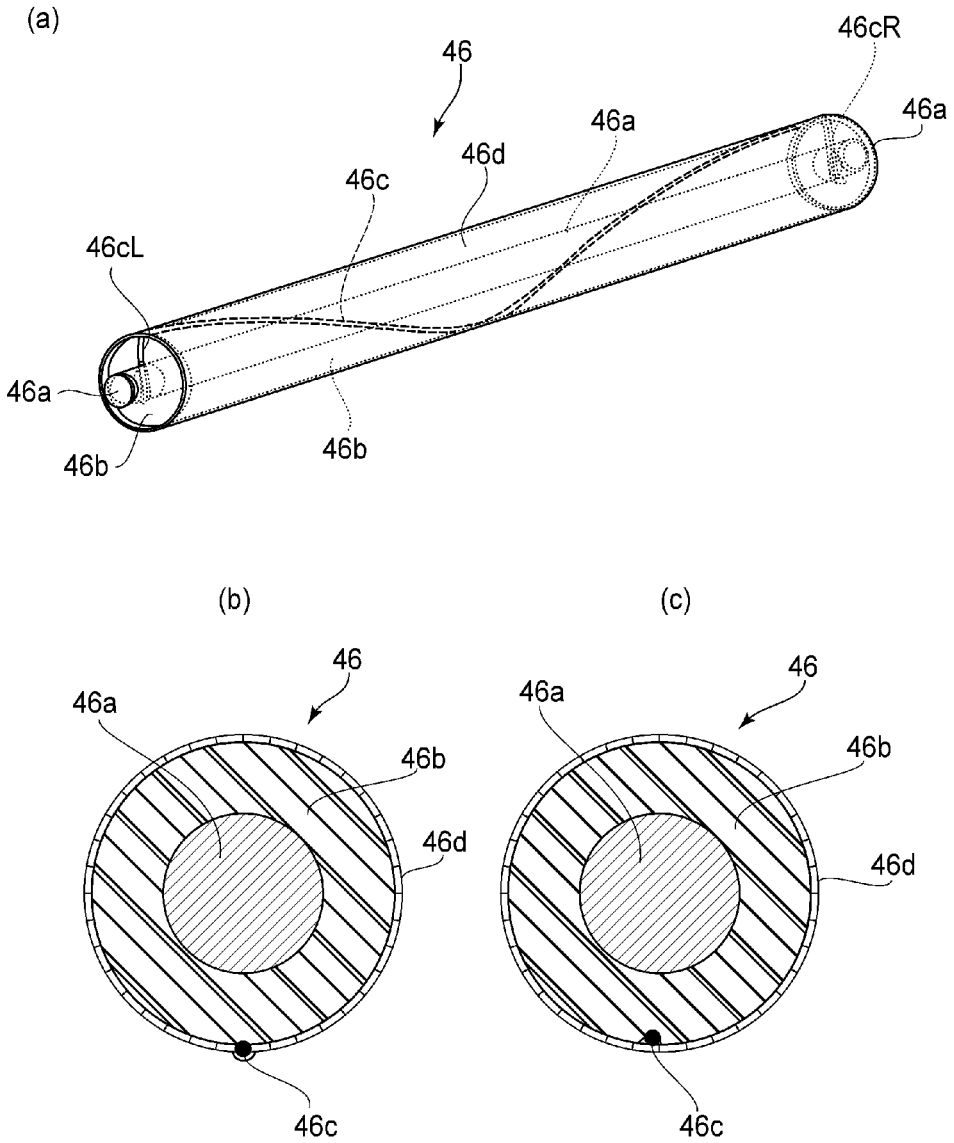
FIG. 7 is an illustration of a web roller.

In view of the foregoing, according to this embodiment, the web roller 46 is a structure as shown in part (a) of FIG. 7. As is different from the conventional web roller 46 shown in FIG. 10, a coating layer (toner parting layer) 46*d* is provided on the outer peripheral surface of the elastic layer including the wire 46*c*, in this embodiment. As a result, transition of the toner onto the sponge layer of the web roller can be suppressed. In addition, the above-described deviation of the wire 46*c* can be prevented. Further, even in such a case that the cleaning web is torn, the wire does not directly contact to the cleaning roller, and therefore, the deterioration of the collection roller 41 can be avoided.

In this embodiment, the coating layer (toner parting layer) 46*d* of fluorine resin material coats the sponge layer (elastic layer) including the wire. Specifically, the coating layer 46*d* is a PFA tube having a thickness of 100 μm. The PFA exhibits good toner parting property and good slidability. Furthermore, even when directly contacting the collection roller 41, the wire does not damage the collection roller 41. The PFA tube 46*d* has a thermal contraction property (thermal contraction property resin material tube). Therefore, a certain degree of pressure is always applied to the wire 46*c* so that the positional deviation of the wire 46*c* on the surface of the elastic layer can be suppressed.

Part (b) of FIG. 7 is a schematic enlarged cross-sectional view of part (a) of FIG. 7. An outer configuration of the web roller 46 in the cross-section is such that the part where the wire 46*c* exists protrudes as compared with the part where the wire 46*c*does not exist. However, in the configuration shown in part (c) of FIG. 7, the part where the wire 46*c* exists does not protrude.

In either of these cases, the wire 46*c* is effective to press-contact with the web 48 to the surface of the collection roller 41 by the restoring force of the elastic member provided behind the rear side of the wire 46*c* in this state that the elastic layer 46*b* is elastically deformed. Therefore, the pressure applied by the cleaning web 48 to the collection roller 41 can be locally increased.

According to this embodiment, a local high pressure portion can be provided in the nip by the wire 46*c* without the deviation of the wire 46*c*, so that the production of the agglomerated mass 80 of the toner on the collection roller 41 can be suppressed.

In addition, even when the cut-away portion 48*a* of the web 48 passes through the nip between the collection roller 41 and the web roller 46, the wire 46*c* of the web roller 46 does not directly contact the collection roller 41 because of the existence of the PFA tube 46*d* therebetween. Thus, the direct contact of the wire 46*c* to the collection roller 41 can be prevented. Therefore, the damage to the collection roller 41 can be prevented, and the image defect attributable to the fixing roller damage and the image defect attributable to the defective cleaning can be avoided.

As described in the foregoing, according to this embodiment, the cleaning property can be enhanced, and therefore, the frequency of exchange of parts is reduced. In addition, the surface property of the fixing member can be maintained, and therefore, the quality of the prints can be enhanced with stabilized continuous printing operation.

[Embodiment 2]

In the description of Embodiment 2, the structures are similar to those of Embodiment 1 unless particular mentioning is made, and a part of the structure of the web roller is different from that of Embodiment 1.

In order to further suppress the deviation of the wire 46*c* on the surface of the elastic layer 46*b* of the web roller 46, an adhesive material 46*e* is soaked into between the elastic layer 46*b* and wire 46*c* and the PFA tube 46*d*.

Figure 8:
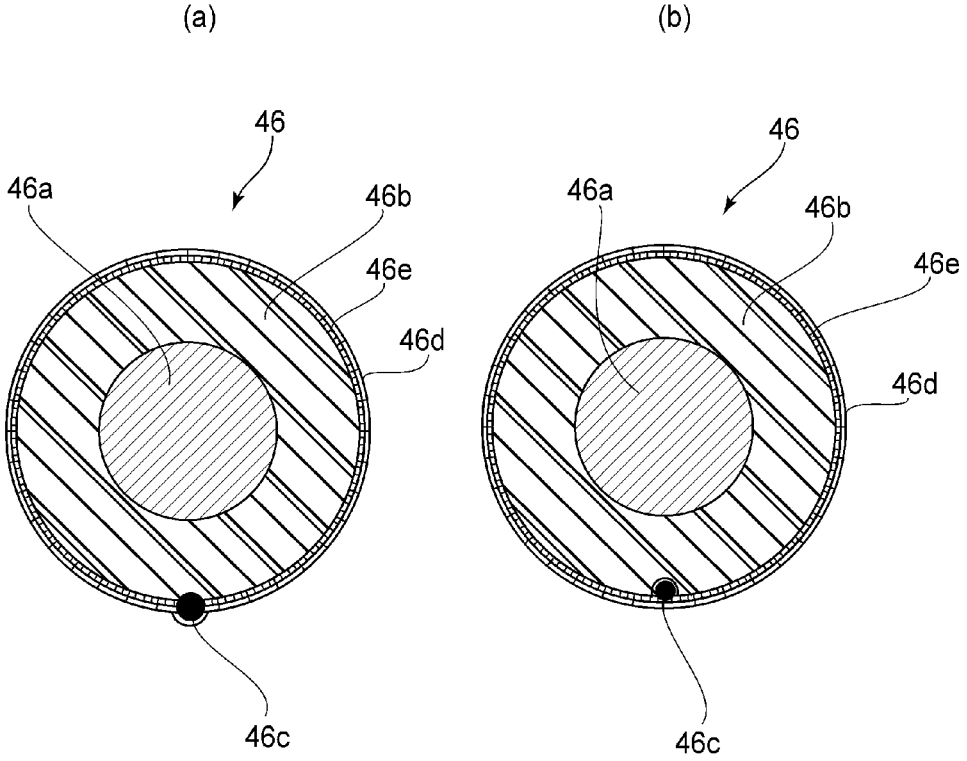
FIG. 8 is an illustration of a web roller.

As shown in parts (a) and (b) of FIG. 8, a bonding material layer 46*e* is provided between the elastic layer 46*b* and the coating layer 46*d*, and the wire 46*c* is in the bonding material layer 46*e*. By the provision of the bonding material layer, the deviation of the wire 46*c* on the surface of the elastic layer 46*b* can be further suppressed.

[Embodiment 3]

In the description of Embodiment 3, the structures are similar to those of Embodiment 1 unless particular mentioning is made, and a part of the structure of the web roller is different from that of Embodiment 1.

Figure 9:
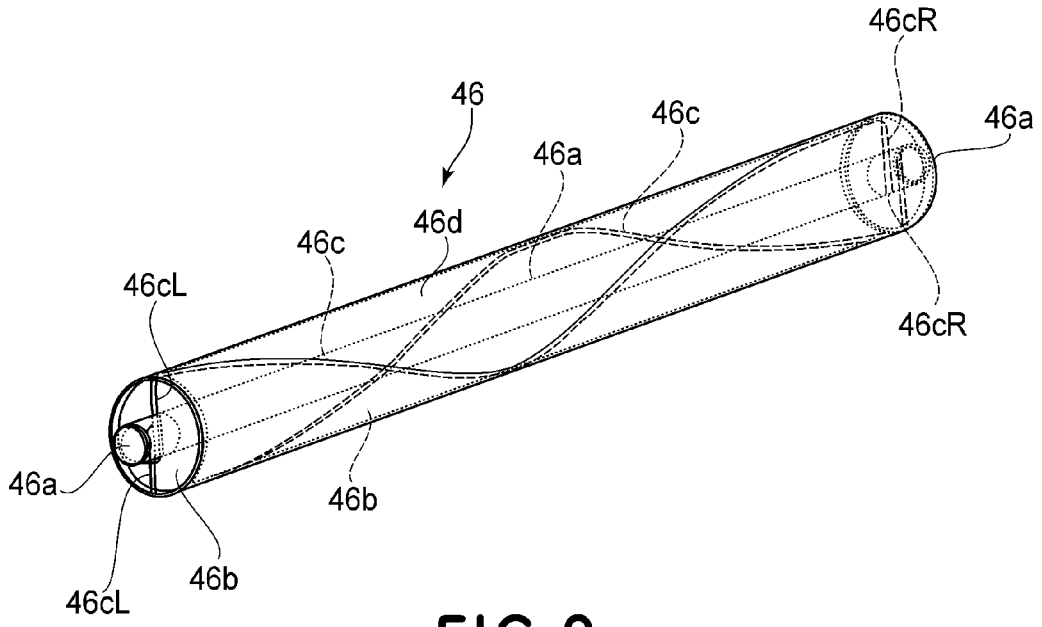
FIG. 9 is an illustration of a web roller.

As shown in FIG. 9, in this embodiment, two or more wires 46*c* (two in FIG. 9) are provided on the surface of the elastic layer 46*b* and extended spirally along the roller axial direction The wire 46*c* may be extended not spirally, and for example, one or more wires 46*c* may extend linearly along the generatrix direction of the roller with a space or spaces in the circumferential direction of the roller. Furthermore, the wire 46*c* is not limited to linear shape, but may be bent into a waveform or the like.

[Embodiment 4]

In the description of Embodiment 4, the structures are similar to those of Embodiment 1 unless particular mentioning is made, and a part of the structure of the web roller is different from that of Embodiment 1.

This embodiment is directed to the problem which will be described below.

In the foregoing embodiments, the end portions 46*c*L, 46*c*R of the wire 46*c* are fixed on the core metal 46*a*, and therefore, the pressure distribution at the end portions may change significantly depending on the position of the fixing, with the possible result of unstable pressure distribution. An outer diameter of the web roller 46 is ϕ30 mm, and the portion where the wire 46*a* exists protrudes by 0.5-0.8 mm. In this case, if the wire end portions 46*c*L, 46*c*R are fixed on the core metal 46*a*, the pressure at the end portion is all applied to the wire end portion 46*c*L, 46*c*R with the possible result of excessive stress in the web 48, which may lead to tearing of the web 48.

Figure 11:
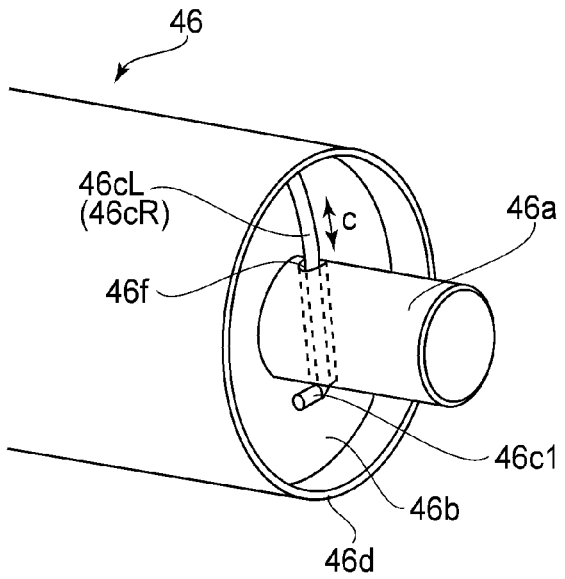
FIG. 11 is an enlarged perspective view of an end portion of the web roller.

As shown in FIG. 11, in view of this, in this embodiment, the end portions 46*c*L, 46*c*R of the wire 46*c* are made slidable relative to the core metal 46*a*.

In the example of FIG. 11, the end portion 46*c*L, 46*c*R of the wire 46*c* is bent toward the core metal 46*a* (along the end surface corresponding to the sponge layer) and is inserted into a hole 46*f* having a diameter larger than the diameter of the wire 46*c* and extending in the radial direction of the core metal 46*a*. A portion 46*c*1 projected out of the hole 46*f* is bent into a retaining portion, at each of the new portions. By doing so, the end portions 46*c*L and 46*c*R of the wire 46*c* are slidably engaged with the core metal 46*a*.

In other words, the wire 46*c* spirally extends on the surface of the elastic layer 46*b* along with the axial direction of the roller, and the end portions 46*c*L and 46*c*R are engaged with the core metal 46*a* so as to be movable in the diametrical direction of the core metal 46*a*.

More specifically, the core metal 46*a* is provided with a hole 46*f* of ϕ2 mm extending in the radial direction, at each of the axial end portions, and the wire 46*c* is bent into an end portion 46*c*L, 46*c*R which is penetrated through the hole 46*f*, and the end of the end portion 46*c*L, 46*c*R is bent into a L shape to prevent disengagement of the wire 46*c*. The diameter of the wire 46*c* is ϕ1.0 mm, and in the diameter of the hole 46*f* of the core metal 46*a* is ϕ2.0 mm, and therefore, the wire 46*c* is easily slidable in the radial direction of the roller.

Figure 12:
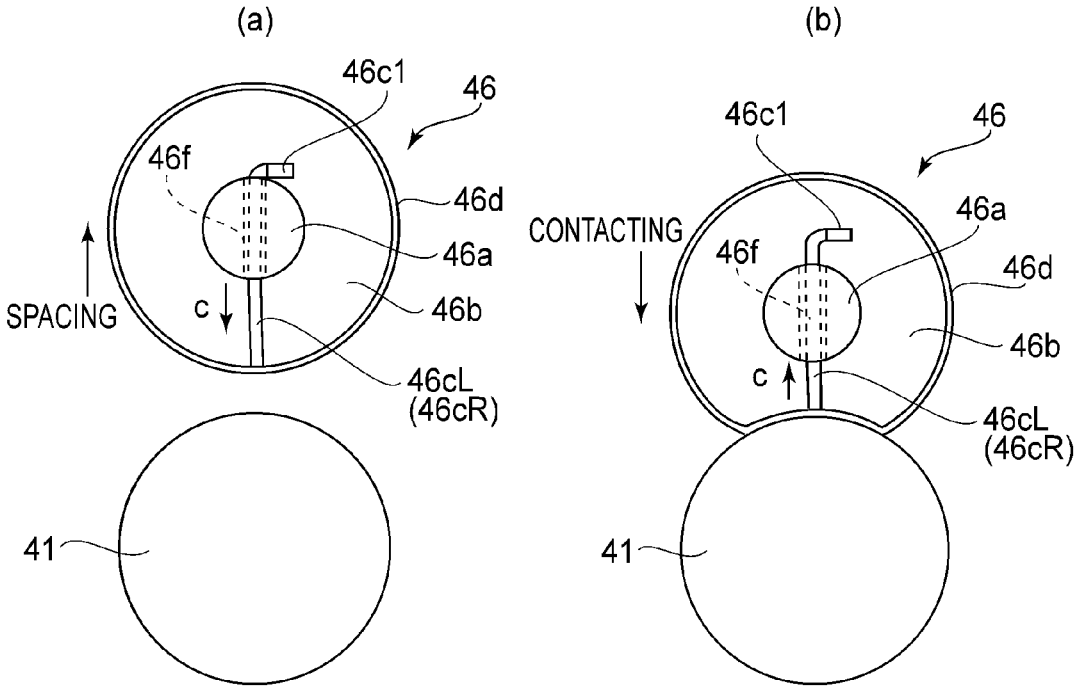
FIG. 12 is an illustration of sliding operation at an end portion of the wire.

The sliding direction c (FIG. 12) is toward the axis of the web roller 46. When the web roller 46 urges the web 68 to the collection roller 41 (part (a) →part (b) of FIG. 12), the end portion 46*c*L, 46*c*R slides in the hole 46*f*. In FIG. 1, cleaning web 68 is omitted for better understanding. By the sliding of the bent end portions 46*c*L, 46*c*R of the wire 46 with the formation of the elastic layer, extreme pressure rises at the wire end portions can be avoided.

With this structure, the possible tearing of the web 48 can be prevented, and therefore, the damage to the collection roller 41, the deterioration of the cleaning property, the image defect which are attributable to the tearing of the web 48 can be prevented.

As described in the foregoing, according to this embodiment, the cleaning property can be enhanced, and therefore, the frequency of exchange of parts is reduced. In addition, the surface property of the fixing member can be maintained, and therefore, the quality of the prints can be enhanced with stabilized continuous printing operation.

[Embodiment 5]

In the description of Embodiment 5, the structures are similar to those of Embodiment 1 unless particular mentioning is made, and a part of the structure of the web roller is different from that of Embodiment 1.

In this embodiment, the method of fixing the wire is different from that of Embodiment 4.

Figure 13:
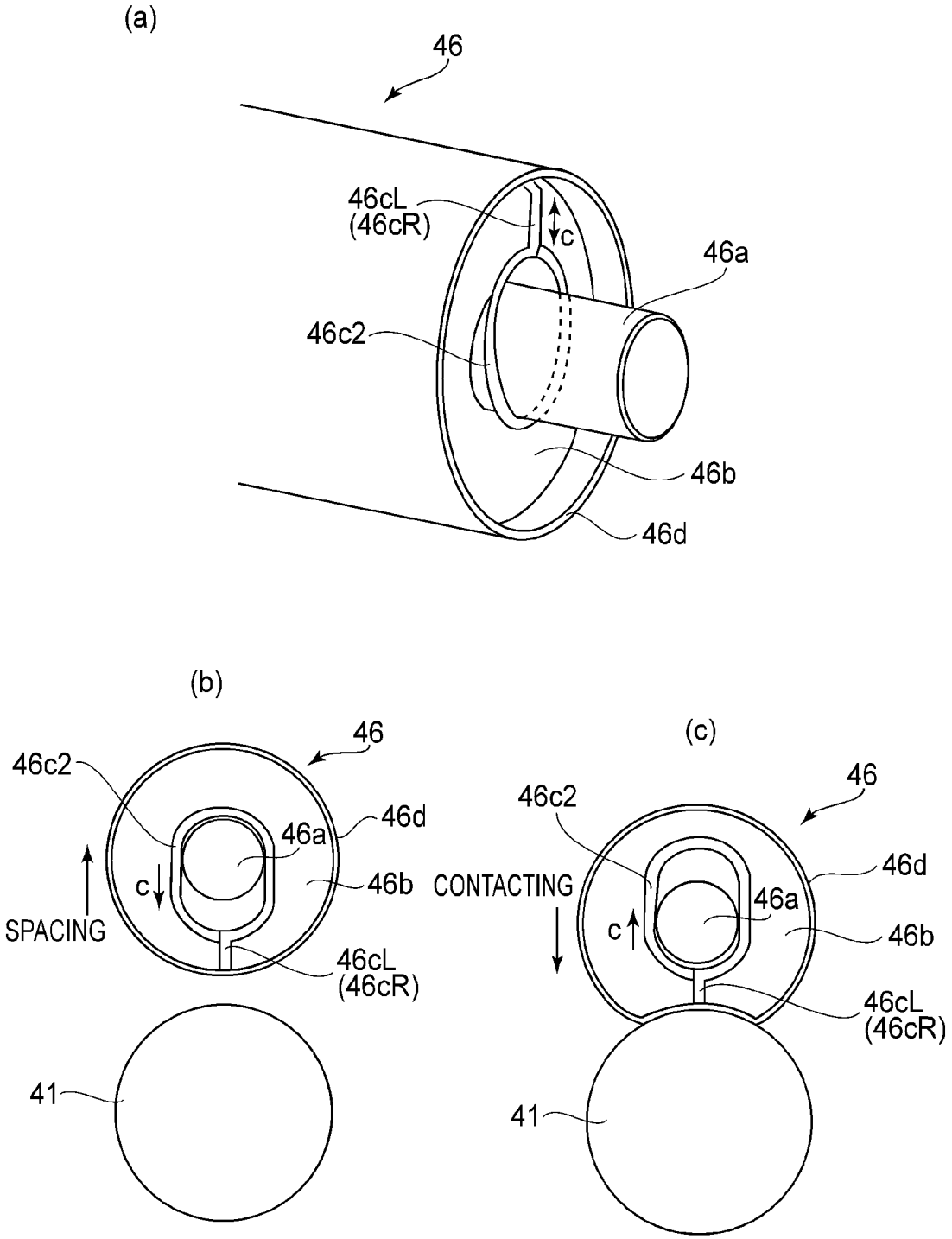
FIG. 13 is an enlarged perspective view of an end portion of the web roller.

FIG. 13 shows the slidable engagement of the end portion 46*c*L, 46*c*R of the wire 46 wherein the core metal 46*a*, according to this embodiment. End portion 46*c*L, 46*c*R of the wire 46 is bent toward the core metal 46*a*, and is further bent into a loop 46*c*2 defining an elongated hole around the core metal 46*a*, so that the end portion 46*c*L, 46*c*R of the wire 46 is slidably engaged with the core metal 46*a*. With this structure, it is not necessary that the hole 46*f* is formed through the core metal 46*a*.

In other words, the wire 46*c* spirally extends on the surface of the elastic layer 46*b* along with the axial direction of the roller, and the end portions 46*c*L and 46*c*R are engaged with the core metal 46*a* so as to be movable in the diametrical direction of the core metal 46*a*.

The structure for slidably engaging the end portion 46*c*L, 46*c*R of the wire 46 with the core metal 46*a* is not limited to Embodiment 4 and 5, but may be another which can be selected by a person skilled in the art.

In the Embodiments 4 and 5, two or more wires 46*c* can be spirally extended along the roller axial direction on the surface of the elastic layer 46*b*.

The wire 46*c* may be extended not spirally, and for example, one or more wires 46*c* may extend linearly along the generatrix direction of the roller with a space or spaces in the circumferential direction of the roller. Furthermore, the wire 46*c* is not limited to linear shape, but may be bent into a waveform or the like.

[Others]

1) In the foregoing description of the embodiments, the member to be cleaned has been a collection roller 41, but may be another rotatable member used in an electrophotographic image forming apparatus.

2) The image heating apparatus is not limited to a fixing device described in the foregoing. It may be a device for temporary fixing a toner image formed on a sheet, or a glossiness improving device for improving the glossiness of a toner image by heating an already fixed toner image.

The electrophotographic image forming apparatus is not limited to a printer, but it may be a copying machine, a facsimile machine or a multifunction machine having and the functions of them, or the like. In addition, it is not limited to a color image forming apparatus, but may be a monochromatic image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Applications Nos. 027558/2014 and 027559/2014 filed Feb. 17, 2014 and Feb. 17, 2014, respectively, which are hereby incorporated by reference.

What is claimed is:

1. An urging roller for urging a cleaning web to a rotatable member of an electrophotographic image forming apparatus, said urging roller comprising:

a shaft;

an elastic layer provided on a peripheral surface of said shaft;

a wire wound on a peripheral surface of said elastic layer; and a toner parting layer covering (a) a peripheral surface of said elastic layer and (b) said wire winding on the peripheral surface of said elastic layer.

2. An urging roller according to claim 1, wherein said wire spirally extends on the peripheral surface of said elastic layer.

3. An urging roller according to claim 2, wherein opposite longitudinal end portions of said wire are bent along respective opposite longitudinal end surfaces of said elastic layer, and said end portions are movable in a diametrical direction of said shaft.

4. An urging roller according to claim 3, wherein opposite longitudinal end portions of said shaft are provided with respective through-holes which are penetrated by the opposite end portions of said wire, which is bent at opposite ends to prevent disengagement of said wire from said shaft.

5. An urging roller according to claim 1, wherein said elastic layer is a porous layer.

6. An urging roller according to claim 1, wherein said wire is made of metal.

7. An urging roller according to claim 1, wherein said toner parting layer is made of fluorine resin material.

8. A cleaning device for cleaning a rotatable member for an electrophotographic image forming apparatus, said cleaning device comprising:

(i) a cleaning web for cleaning the rotatable member;

(ii) a wound roller on which said cleaning web is wound;

(iii) a winding-up roller for winding said cleaning web up; and (iv) the urging roller according to claim 1.

9. A cleaning device according to claim 8, wherein said wire spirally extends on the peripheral surface of said elastic layer.

10. A cleaning device according to claim 9, wherein opposite longitudinal end portions of said wire are bent along respective opposite longitudinal end surfaces of said elastic layer, and said end portions are movable in a diametrical direction of said shaft.

11. A cleaning device according to claim 10, wherein opposite longitudinal end portions of said shaft are provided with respective through-holes which are penetrated by the opposite end portions of said wire, which is bent at opposite ends to prevent disengagement of said wire from said shaft.

12. A cleaning device according to claim 8, wherein said elastic layer is a porous layer.

13. A cleaning device according to claim 8, wherein said wire is made of metal.

14. A cleaning device according to claim 8, wherein said toner parting layer is made of fluorine resin material.

15. An image heating apparatus comprising:

(i) a rotatable heating member for heating a toner image on a sheet;

(ii) a rotatable member for collecting toner deposited on said rotatable heating member; and (iii) the cleaning device according to claim 8.

16. An apparatus according to claim 15, wherein said wire spirally extends on the peripheral surface of said elastic layer.

17. An apparatus according to claim 16, wherein opposite longitudinal end portions of said wire are bent along respective opposite longitudinal end surfaces of said elastic layer, and said end portions are movable in a diametrical direction of said shaft.

18. An apparatus according to claim 17, wherein opposite longitudinal end portions of said shaft are provided with respective through-holes which are penetrated by the opposite end portions of said wire, which is bent at opposite ends to prevent disengagement of said wire from said shaft.

19. An apparatus according to claim 15, wherein said elastic layer is a porous layer.

20. An apparatus according to claim 15, wherein said wire is made of metal.

21. An apparatus according to claim 15, wherein said toner parting layer is made of fluorine resin material.

* * * * *